US009460725B2

(12) United States Patent
Kim et al.

(10) Patent No.: US 9,460,725 B2
(45) Date of Patent: Oct. 4, 2016

(54) METHOD, MEDIUM, AND APPARATUS ENCODING AND/OR DECODING EXTENSION DATA FOR SURROUND

(75) Inventors: Jung-hoe Kim, Seoul (KR); Eun-Mi Oh, Seongnam-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 710 days.

(21) Appl. No.: 13/551,235

(22) Filed: Jul. 17, 2012

(65) Prior Publication Data

US 2012/0281842 A1 Nov. 8, 2012

Related U.S. Application Data

(62) Division of application No. 11/826,168, filed on Jul. 12, 2007, now Pat. No. 8,270,617.

(30) Foreign Application Priority Data

Jul. 12, 2006 (KR) ..... 10-2006-0065590
Oct. 24, 2006 (KR) ..... 10-2006-0103614
Jul. 3, 2007 (KR) ..... 10-2007-0066770

(51) Int. Cl.
*H04R 5/00* (2006.01)
*G10L 19/008* (2013.01)
*H04S 3/02* (2006.01)

(52) U.S. Cl.
CPC ..... *G10L 19/008* (2013.01); *H04S 3/02* (2013.01)

(58) Field of Classification Search
CPC ..... H04R 5/00; G10L 19/00; G10L 21/00; G10L 19/008; H04S 3/02
USPC ..... 381/1, 17, 22–23; 704/229, 200.1, 704/500–501, 201, 219, E19.01, E19.048
See application file for complete search history.

(56) References Cited

U.S. PATENT DOCUMENTS 5,845,239 A * 12/1998 Laczko et al. ..... 704/200
5,850,456 A 12/1998 Ten Kate et al.
6,138,051 A * 10/2000 Dieterich ..... 700/94
6,925,340 B1 * 8/2005 Suito et al. ..... 700/94
8,731,204 B2 * 5/2014 Sperschneider ..... G10L 19/008 381/22
9,060,236 B2 * 6/2015 Engdegard ..... G10L 19/008
2005/0074127 A1 4/2005 Herre et al.

(Continued)

FOREIGN PATENT DOCUMENTS

EP 05254305.5 1/2006

OTHER PUBLICATIONS

PCT International Search Report and the Written Opinion of the International Searching Authority mailed Oct. 23, 2007 in corresponding International Application No. PCT/KR2007/003386.

(Continued)

*Primary Examiner* — Disler Paul
(74) *Attorney, Agent, or Firm* — Staas & Halsey LLP

(57) ABSTRACT

A method, medium, and apparatus encoding and/or decoding an audio signal to surround data. While encoding spatial information, which can up-mix an audio signal to a surround signal, to extension data, a length of a payload corresponding to the spatial information is encoded and a payload of the spatial information is decoded using the length of the payload. Accordingly, compatibility of the spatial information can be provided, and the spatial information can be transmitted by effectively embedding the spatial information.

7 Claims, 11 Drawing Sheets

(56) References Cited

U.S. PATENT DOCUMENTS

| | | | | |
|---|---|---|---|---|
| 2006/0013405 | A1* | 1/2006 | Oh et al. | 381/23 |
| 2006/0235678 | A1 | 10/2006 | Kim et al. | |
| 2007/0083363 | A1* | 4/2007 | Kim | G10L 19/0017 704/229 |
| 2009/0161795 | A1* | 6/2009 | Oh | H04H 20/89 375/316 |
| 2009/0240504 | A1* | 9/2009 | Pang et al. | 704/500 |

OTHER PUBLICATIONS

Korean Office Action mailed Sep. 23, 2013 in corresponding Korean Application No. 10-2007-0066770.

"Coding of Moving Pictures and Audio," International Organization for Standardization, ISO/IEC JTC 1/SC 29/WG 11, N8169, Apr. 2006, Montreux, Switzerland.

"Coding of Moving Pictures and Audio," International Organization for Standardization, ISO/IEC JTC 1/SC 29/WG 11, N8612, Oct. 2006, Hangzhou, China.

International Search Report mailed Oct. 23, 2007 issued in corresponding International Patent Application No. PCT/KR2007/003386.

J. Herre et al., "The Reference Model Architecture for MPEG Spatial Audio Coding", Audio Engineering Society, Convention Paper 6447 Presented at the 118$^{th}$ Convention, May 2005, pp. 1-13.

Martin Wolters et al., "A closer look into MPEG-4 High Efficiency AAC", Audio Engineering Society, Convention Paper Presented at the 115$^{th}$ Convention, Oct. 2003, pp. 1-16.

U.S. Appl. No. 11/826,168, filed Jul. 12, 2007, Jung-hoe Kim, Samsung Electronics Co., Ltd.

Office Action (Restriction) issued Apr. 21, 2011 in U.S. Appl. No. 11/826,168 now U.S. Pat. No. 8,270,617 (5 pages).

Non-final Office Action issued Nov. 1, 2011 in U.S. Appl. No. 11/826,168 now U.S. Pat. No. 8,270,617 (11 pages).

Notice of Allowance issued Apr. 17, 2012 in U.S. Appl. No. 11/826,168 now U.S. Pat. No. 8,270,617 (23 pages).

* cited by examiner

FIG. 2A

| Syntax | No. of bits | Mnemonic |
|---|---|---|
| bsac_raw_data_block() | | |
| { | | |
| 200 bsac_base_element(); | | |
| layer=slayer_size; | | |
| while(data_available() && layer<(top_layer+slayer_size)) { | | |
| 210 bsac_layer_element(layer); | | |
| layer++; | | |
| } | | |
| byte_alignment(); | | |
| if (data_available()) { | | |
| 215 **zero_code** | **32** | **bslbf** |
| 220 **sync_word** | **4** | **bslbf** |
| 240 While( data_available() ) { | | |
| 225 **extension_type** | **4** | **bslbf** |
| switch(extension_type) { | | |
| case EXT_BSAC_CHANNEL : | | |
| extended_bsac_raw_data_block(); | | Note 1 |
| break; | | |
| case EXT_BSAC_SBR_DATA : | | |
| extended_bsac_sbr_data(nch, 0); | | |
| break; | | |
| case EXT_BSAC_SBR_DATA_CRC : | | |
| extended_bsac_sbr_data(nch, 1); | | |
| break; | | |
| case EXT_BSAC_CHANNEL_SBR : | | |
| extended_bsac_raw_data_block(); | | Note 1 |
| extended_bsac_sbr_data(nch, 0); | | |
| break; | | |
| case EXT_BSAC_CHANNEL_SBR_CRC : | | |
| extended_bsac_raw_data_block(); | | Note 1 |
| extended_bsac_sbr_data(nch, 1); | | |
| break; | | |
| 230 case EXT_BSAC_SAC_DATA : | | |
| 235 extended_bsac_sac_data(); | | |
| break; | | |
| default : | | |
| extended_bsac_data(); | | |
| break; | | |
| } | | |
| byte_alignment(); | | |
| } | | |
| } | | |
| } | | |

Note 1 : The byte_alignment() functions in extended_bsac_raw_data_block() are relative to the start of extended_bsac_raw_data_block().

FIG. 2B

| Symbol | Value of extension_type | Purpose |
|---|---|---|
| EXT_BSAC_CHANNEL | '1 1 1 1' | BSAC channel extension |
| EXT_BSAC_SBR_DATA | '0 0 0 0' | BSAC SBR enhancement |
| EXT_BSAC_SBR_DATA_CRC | '0 0 0 1' | BSAC enhancement with CRC |
| EXT_BSAC_SAC_DATA | '0 0 1 0' | MPEG Surround enhancement |
| EXT_BSAC_CHANNEL_SBR | '1 1 1 0' | BSAC channel extension with SBR |
| EXT_BSAC_CHANNEL_SBR_CRC | '1 1 0 11' | BSAC channel extension with SBR_CRC |
| RESERVED | '0 0 1 1 ' ~ '1 1 0 0' | reserved |

FIG. 4A

| | Syntax | No. of bits | Mnemonic |
|---|---|---|---|
| | extended_bsac_sac_data() | | |
| | { | | |
| 413 | cnt = **count;** | **8** | **uimsbf** |
| | if (cnt = = 255) { | | |
| | cnt += **esc_count** − **1**; | **8** | **uimsbf** |
| | } | | |
| 400 | **ancType;** | **2** | **uimsbf** |
| 405 | **ancStart;** | **1** | **uimsbf** |
| 410 | **ancStop;** | **1** | **uimsbf** |
| 415 | **bs_crc_flag** | **1** | **uimsbf** |
| | **bs_fill_bits** | **3** | **uimsbf** |
| | if (bs_crc_flag) { | | |
| 420 | **ancCrcWord;** | **8** | **uimsbf** |
| | cnt = cnt − 1; | | |
| | } | | |
| | for (i=0; i<cnt−2; i++) { | | |
| 425 | **ancDataSegmentByte** [i]; | **8** | **bslbf** |
| | } | | |
| | } | | |

FIG. 4B

| **ancType** | **Meaning** |
|---|---|
| 0x0 | SacDataFrame(0) (MPEG Surround frame) |
| 0x1 | SacDataFrame(1) (MPEG Surround header and MPEG Surround frame) |
| 02..0x3 | (reserved) |

METHOD, MEDIUM, AND APPARATUS ENCODING AND/OR DECODING EXTENSION DATA FOR SURROUND

CROSS-REFERENCE TO RELATED APPLICATIONS

This application is a U.S. divisional application of U.S. Ser. No. 11/826,168 filed in the United States Patent and Trademark Office on Jul. 12, 2007 now U.S. Pat. No. 8,270,617, which claims earlier priority benefit to Korean Patent Application Nos. 10-2006-0065590, filed on Jul. 12, 2006; 10-2006-0103614, filed on Oct. 24, 2006; and 10-2007-0066770, filed on Jul. 3, 2007, in the Korean Intellectual Property Office, the disclosures of each of which are incorporated herein in their entirety by reference.

BACKGROUND

1. Field

One or more embodiments of the present invention relate to a method, medium, and apparatus encoding and/or decoding audio data, such as for voice or music signals, and more particularly, to a method, medium, and apparatus encoding and/or decoding audio data to surround data.

2. Description of the Related Art

Conventionally, there are primarily two techniques of transmitting an encoded audio signal and spatial information used in up-mixing an audio signal to surround data. In the first technique, the audio signal and spatial information are each transmitted using separate channels. In the second technique, spatial information is included with the audio signal in an encoded bit stream, e.g., as a field, for extending an audio signal.

However, in the second technique, the encoding device for encoding the audio signal and the device for processing the spatial information may not be the same device or even compatible. Regardless, in this technique, a resultant bit stream is prepared by dividing a data block, encoded by the device for processing the spatial information, into a plurality of data segments, and suitably distributing each of the data segments into a bit stream having the encoded audio signal.

When a payload of extension data, which can be used to extend the bandwidth of the encoded audio signal, and such a data segment of spatial information are both prepared in a field for extension for the bit stream, and the payload is prepared prior to the data segment, the payload is decoded first, and then the data segment is decoded by calculating the length of the payload. However, when the data segment is prepared prior to the payload, the payload may actually be incorrectly categorized as the data segment, since there is no information about the length of the payload.

SUMMARY

Accordingly, one or more embodiments of the present invention provide a method, medium, and apparatus encoding and/or decoding additional information, which can up-mix an audio signal to a surround signal, to extension data.

Additional aspects and/or advantages will be set forth in part in the description which follows and, in part, will be apparent from the description, or may be learned by practice of the invention.

According to an aspect of the present invention, there is provided a method of decoding extension data for surround, the method including decoding audio data which is hierarchically encoded, and decoding additional information for decoding the audio data to surround data.

According to another aspect of the present invention, there is provided a method of decoding extension data for surround, the method including decoding audio data which is hierarchically encoded, detecting an identification code which indicates that a payload of the audio data has been completed, detecting an identification code which indicates that a payload of extension data has been started, detecting a type of the extension data, determining whether the detected type shows additional information for decoding the audio data to surround data, and when it is determined that the detected type shows the additional information, decoding extension data corresponding to the additional data.

According to another aspect of the present invention, there is provided a method of decoding extension data for surround, the method including decoding audio data which is hierarchically encoded, detecting 'zero_code', detecting 'sync_word', detecting 'extension_type', determining whether the detected 'extension_type' shows additional information for decoding the audio data to surround data, and when it is determined that the detected 'extension_type' shows the additional information, decoding extension data corresponding to the additional data.

According to another aspect of the present invention, there is provided a method of decoding extension data for surround, corresponding to additional information for decoding audio data to surround data, the method including detecting an identifier indicating a data type of a data segment, determining whether the data segment is a data segment that starts a data block, determining whether the data segment is a data segment that stops the data block, and decoding the data segment, and when there are continuous data segments prior to the data segment, connecting the continuous data segments to the decoded data segment.

According to another aspect of the present invention, there is provided a method of decoding extension data for surround, corresponding to additional information for decoding audio data to surround data, the method including detecting an identifier which shows a data type of a data segment, detecting an identifier which shows whether the data segment is a data segment that starts a data block, detecting an identifier which shows whether the data segment is a data segment that stops the data block, and decoding the data segment, and when there are continuous data segments prior to the data segment, connecting the continuous data segments to the decoded data segment.

According to another aspect of the present invention, there is provided an apparatus for decoding extension data for surround, the apparatus including an audio data decoder which decodes audio data that is hierarchically encoded, and an additional information decoder which decodes additional information for decoding the audio data to surround data.

According to another aspect of the present invention, there is provided an apparatus for decoding extension data for surround, the apparatus including an audio data decoder which decodes audio data that is hierarchically encoded, a complete code detector which detects an identification code indicating that a payload of the audio data has been completed, a start code detector which detects an identification code indicating that a payload of extension data has been started, an extension type detector which detects a type of the extension data, a determiner which determines whether the detected type shows additional information for decoding the audio data to surround data, and an extension data decoder which decodes extension data corresponding to the additional information when the determiner determines that the detected type shows the additional information.

According to another aspect of the present invention, there is provided an apparatus for decoding extension data for surround, the apparatus including an audio data decoder which decodes audio data that is hierarchically encoded, a complete code detector which detects 'zero_code', a start code detector which detects 'sync_word', an extension type detector which detects 'extension_type', a determiner which determines whether the detected 'extension_type' shows additional information for decoding the audio data to surround data, and an additional information decoder which decodes extension data corresponding to the additional information when the determiner determines that the detected 'extension_type' shows the additional information.

According to another aspect of the present invention, there is provided an apparatus for decoding extension data for surround, corresponding to additional information for decoding audio data to surround data, the apparatus including a type detector which detects an identifier indicating a data type of a data segment, a block start determiner which determines whether the data segment is a data segment that starts a data block, a block stop determiner which determines whether the data segment is a data segment that stops the data block, and a connector which decodes the data segment, and when there are continuous data segments prior to the data segment, connecting the continuous data segment to the decoded data segment.

According to another aspect of the present invention, there is provided an apparatus for decoding extension data for surround, corresponding to additional information for decoding audio data to surround data, the apparatus including a type detector which detects an identifier indicating a data type of a data segment, a block start identifier detector which detects an identifier indicating whether the data segment is a data segment starting a data block, a block stop identifier detector which detects an identifier indicating whether the data segment is a data segment starting the data block, and a connector which decodes the data segment, and when there are continuous data segments prior to the data segment, connecting the continuous data segment to the decoded data segment.

According to another aspect of the present invention, there is provided a computer readable recording medium having recorded thereon a program for executing a method of decoding extension data for surround, the method including decoding audio data which is hierarchically encoded, and decoding additional information for decoding the audio data to surround data.

According to another aspect of the present invention, there is provided a computer readable recording medium having recorded thereon a program for executing a method of decoding extension data for surround, the method including decoding audio data which is hierarchically encoded, detecting an identification code which indicates that a payload of the audio data has been completed, detecting an identification code which indicates that a payload of extension data has been started, detecting a type of the extension data, determining whether the detected type shows additional information for decoding the audio data to surround data, and when it is determined that the detected type shows the additional information, decoding extension data corresponding to the additional data.

According to another aspect of the present invention, there is provided a computer readable recording medium having recorded thereon a program for executing a method of decoding extension data for surround, the method including decoding audio data which is hierarchically encoded, detecting 'zero_code', detecting 'sync_word', detecting 'extension_type', determining whether the detected 'extension_type' shows additional information for decoding the audio data to surround data, and when it is determined that the detected 'extension_type' shows the additional information, decoding extension data corresponding to the additional data.

According to another aspect of the present invention, there is provided a computer readable recording medium having recorded thereon a program for executing a method of decoding extension data for surround, corresponding to additional information for decoding audio data to surround data, the method including detecting an identifier indicating a data type of a data segment, determining whether the data segment is a data segment that starts a data block, determining whether the data segment is a data segment that stops the data block, and decoding the data segment, and when there are continuous data segments prior to the data segment, connecting the continuous data segments to the decoded data segment.

According to another aspect of the present invention, there is provided a computer readable recording medium having recorded thereon a program for executing a method of decoding extension data for surround, corresponding to additional information for decoding audio data to surround data, the method including detecting an identifier which shows a data type of a data segment, detecting an identifier which shows whether the data segment is a data segment that starts a data block, detecting an identifier which shows whether the data segment is a data segment that stops the data block, and decoding the data segment, and when there are continuous data segments prior to the data segment, connecting the continuous data segments to the decoded data segment.

According to another aspect of the present invention, there is provided a method of encoding extension data for surround, the method including hierarchically encoding audio data, and encoding additional information for decoding the audio data to surround data.

According to another aspect of the present invention, there is provided a method of encoding extension data for surround, the method including hierarchically encoding audio data, encoding an identification code which indicates that a payload of the audio data has been completed, encoding an identification code which indicates that a payload of extension data has been started, encoding a type of the extension data which shows additional information for decoding the audio data to surround data, and encoding extension data corresponding to the additional information.

According to another aspect of the present invention, there is provided a method of encoding extension data for surround, the method including hierarchically encoding audio data, encoding 'zero_code', encoding 'sync_word', encoding 'extension_type' which shows additional information for decoding the audio data to surround data, and encoding extension data corresponding to the additional information.

According to another aspect of the present invention, there is provided a method of encoding extension data for surround, corresponding to additional information for decoding audio data to surround data, the method including encoding an identifier which indicates a data type of a data segment, encoding an identifier which indicates whether the data segment is a data segment starting a data block, encoding an identifier which indicates whether the data segment is a data segment encoding the data block, and encoding the data segment.

According to another aspect of the present invention, there is provided an apparatus for encoding extension data for surround, the apparatus including an audio data encoder which hierarchically encodes audio data, and an additional information encoder which encodes additional information for decoding the audio data to surround data.

According to another aspect of the present invention, there is provided an apparatus for encoding extension data for surround, the apparatus including an audio data encoder which hierarchically encodes audio data, a complete code encoder which encodes an identification code which shows that a payload of the audio data has been completed, a start code encoder which encodes an identification code which shows that a payload of extension data has been started, an extension type encoder which encodes a type of extension data that shows additional information for decoding the audio data to surround data, and an extension data encoder which encodes extension data corresponding to the additional information.

According to another aspect of the present invention, there is provided an apparatus for encoding extension data for surround, the apparatus including an audio data encoder which hierarchically encodes audio data, a complete code encoder which encodes 'zero_code', a start code encoder which encodes 'sync_word', an extension type encoder which detects 'extension_type' that shows additional information for decoding the audio data to surround data, and an additional information encoder which encodes extension data corresponding to the additional information.

According to another aspect of the present invention, there is provided an apparatus for encoding extension data for surround, corresponding to additional information for decoding audio data to surround data, the apparatus including a type encoder which encodes an identifier indicating a data type of a data segment, a block start code encoder which encodes a code indicating whether the data segment is a data segment starting a data block, a block stop code encoder which encodes a code indicating whether the data segment is a data segment stopping the data block, and a data segment encoder which encodes the data segment.

According to another aspect of the present invention, there is provided a computer readable recording medium having recorded thereon a program for executing a method of encoding extension data for surround, the method including hierarchically encoding audio data, and encoding additional information for decoding the audio data to surround data.

According to another aspect of the present invention, there is provided a computer readable recording medium having recorded thereon a program for executing a method of encoding extension data for surround, the method including hierarchically encoding audio data, encoding an identification code which indicates that a payload of the audio data has been completed, encoding an identification code which indicates that a payload of extension data has been started, encoding a type of the extension data which shows additional information for decoding the audio data to surround data, and encoding extension data corresponding to the additional information.

According to another aspect of the present invention, there is provided a computer readable recording medium having recorded thereon a program for executing a method of encoding extension data for surround, the method including hierarchically encoding audio data, encoding 'zero_code', encoding 'sync_word', encoding 'extension_type' which shows additional information for decoding the audio data to surround data, and encoding extension data corresponding to the additional information.

According to another aspect of the present invention, there is provided a computer readable recording medium having recorded thereon a program for executing a method of encoding extension data for surround, corresponding to additional information for decoding audio data to surround data, the method including encoding an identifier which indicates a data type of a data segment, encoding an identifier which indicates whether the data segment is a data segment starting a data block, encoding an identifier which indicates whether the data segment is a data segment encoding the data block, and encoding the data segment.

According to another aspect of the present invention, there is provided a method of decoding extension data for surround, corresponding to additional information for decoding audio data to surround data, the method including calculating the length of a data segment, detecting an identifier which indicates a data type of the data segment, determining whether the data segment is a data segment starting a data block, determining whether the data segment is a data segment stopping the data block, and decoding a data segment corresponding to the calculated length, and when there are continuous data segments prior to the data segment corresponding to the calculated length, connecting the continuous data segments to the decoded data segment.

According to another aspect of the present invention, there is provided a method of decoding extension data for surround, corresponding to additional information for decoding audio data to surround data, the method including calculating a length of a data segment, detecting an identifier which indicates a data type of the data segment, detecting an identifier which indicates whether the data segment is a data segment starting a data block, detecting an identifier which indicates whether the data segment is a data segment stopping the data block, and decoding a data segment corresponding to the calculated length, and when there are continuous data segments prior to the data segment corresponding to the calculated length, connecting the continuous data segments to the decoded data segment.

According to another aspect of the present invention, there is provided an apparatus for decoding extension data for surround, corresponding to additional information for decoding audio data to surround data, the apparatus including a segment length calculator which calculates a length of a data segment, a type detector which detects an identifier indicating a data type of the data segment, a block start determiner which determines whether the data segment is a data segment starting a data block, a block stop determiner which determines whether the data segment is a data segment stopping the data block, and a connector which decodes a data segment corresponding to the calculated length, and when there are continuous data segments prior to the data segment corresponding to the calculated length, connecting the continuous data segments to the decoded data segment.

According to another aspect of the present invention, there is provided a method of decoding extension data for surround, corresponding to additional information for decoding audio data to surround data, the method including a segment length calculator which calculates a length of a data segment, a type detector which detects an identifier indicating a data type of the data segment, a block start identifier detector which detects an identifier indicating whether the data segment is a data segment starting a data block, a block stop identifier detector which detects an identifier indicating whether the data segment is a data segment stopping the data block, and a connector which decodes a data segment corresponding to the calculated length, and when there are continuous data segments prior to the data segment corresponding to the calculated length, connecting the continuous data segments to the decoded data segment.

According to another aspect of the present invention, there is provided a computer readable recording medium having recorded thereon a program for executing a method of decoding extension data for surround, corresponding to additional information for decoding audio data to surround data, the method including calculating the length of a data segment, detecting an identifier which indicates a data type of the data segment, determining whether the data segment is a data segment starting a data block, determining whether the data segment is a data segment stopping the data block, and decoding a data segment corresponding to the calculated length, and when there are continuous data segments prior to the data segment corresponding to the calculated length, connecting the continuous data segments to the decoded data segment.

According to another aspect of the present invention, there is provided a computer readable recording medium having recorded thereon a program for executing a method of decoding extension data for surround, corresponding to additional information for decoding audio data to surround data, the method including calculating a length of a data segment, detecting an identifier which indicates a data type of the data segment, detecting an identifier which indicates whether the data segment is a data segment starting a data block, detecting an identifier which indicates whether the data segment is a data segment stopping the data block, and decoding a data segment corresponding to the calculated length, and when there are continuous data segments prior to the data segment corresponding to the calculated length, connecting the continuous data segments to the decoded data segment.

According to another aspect of the present invention, there is provided a method of encoding extension data for surround, corresponding to additional information for decoding audio data to surround data, the method including encoding a length of a data segment, encoding an identifier which indicates a data type of the data segment, encoding an identifier which indicates whether the data segment is a data segment starting a data block, encoding an identifier which indicates whether the data segment is a data segment stopping the data block, and encoding a data segment corresponding to the encoded length.

According to another aspect of the present invention, there is provided an apparatus for encoding extension data for surround, corresponding to additional information for decoding audio data to surround data, the apparatus including a segment length calculator which calculates a length of a data segment, a type encoder which encodes an identifier indicating a data type of the data segment, a block start code encoder which encodes a code indicating whether the data segment is a data segment starting a data block, a block stop code encoder which encodes a code indicating whether the data segment is a data segment stopping the data block, and a data segment encoder which encodes a data segment corresponding to the encoded length.

According to another aspect of the present invention, there is provided a computer readable recording medium having recorded thereon a program for executing a method of encoding extension data for surround, corresponding to additional information for decoding audio data to surround data, the method including encoding a length of a data segment, encoding an identifier which indicates a data type of the data segment, encoding an identifier which indicates whether the data segment is a data segment starting a data block, encoding an identifier which indicates whether the data segment is a data segment stopping the data block, and encoding a data segment corresponding to the encoded length.

According to another aspect of the present invention, there is provided a method of decoding extension data for surround, the method comprising: decoding audio data which is hierarchically encoded; decoding additional information for decoding the audio data to a surround audio signal; and restoring the surround audio signal using the decoded audio data and the decoded additional information.

BRIEF DESCRIPTION OF THE DRAWINGS

These and/or other aspects and advantages will become apparent and more readily appreciated from the following description of the embodiments, taken in conjunction with the accompanying drawings of which:

FIG. 2A is a diagram illustrating an example syntax that may be performed in a method, medium, and apparatus decoding extension data for surround, according to an embodiment of the present invention;

FIG. 2B is a table illustrating example symbols, values, and purposes corresponding to each type of extension data;

FIG. 4A is a diagram illustrating an example syntax that may be performed, such as in the operation 140 of FIG. 3 and/or a surround decoder included in an apparatus for decoding extension data for surround, according to an embodiment of the present invention;

FIG. 4B is a table illustrating an example identifier indicating a type of a data segment;

DETAILED DESCRIPTION OF THE EMBODIMENTS

Figure 1:
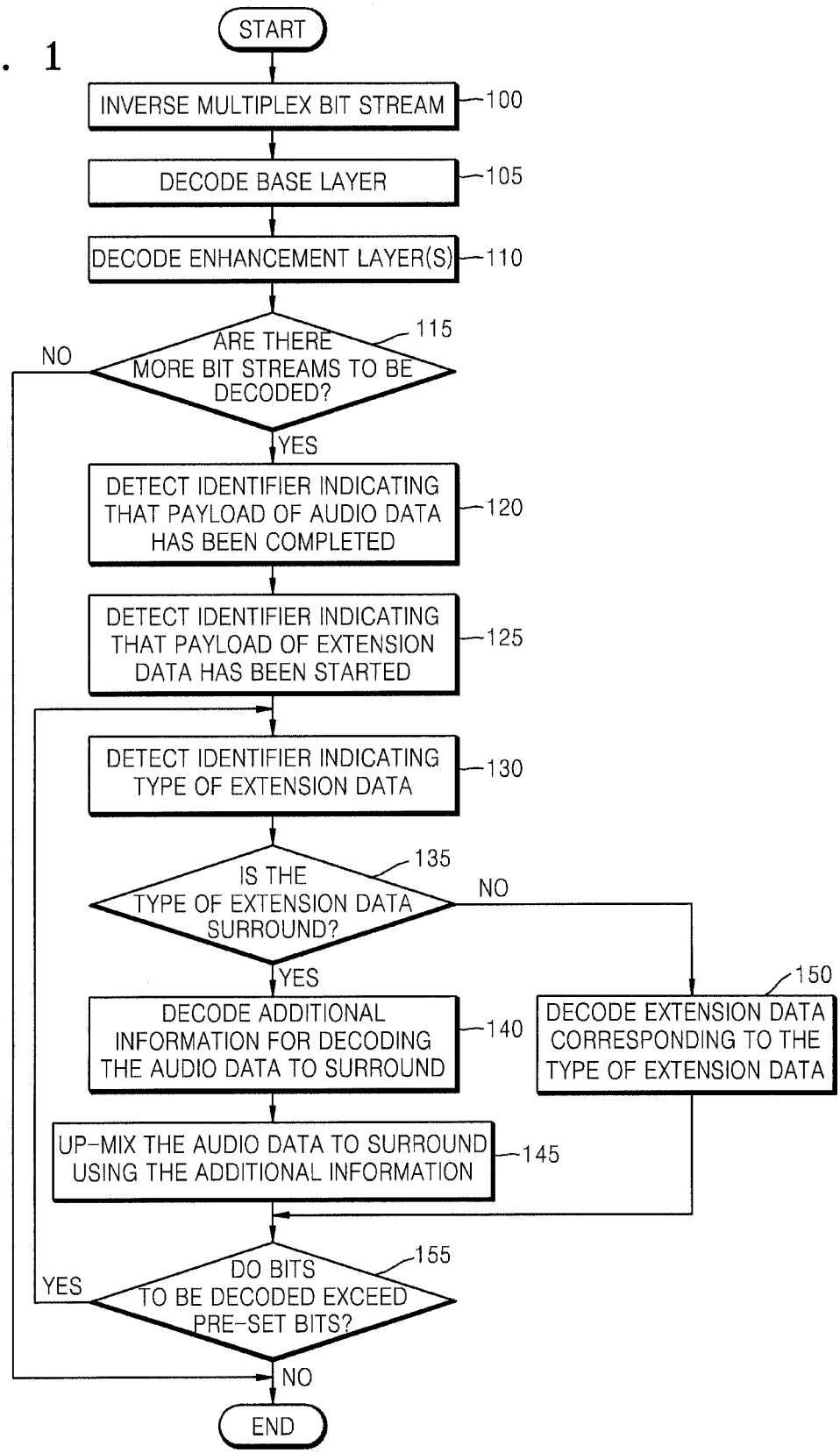
FIG. 1 is a flowchart illustrating a method of decoding extension data for surround, according to an embodiment of the present invention.

Reference will now be made in detail to embodiments, examples of which are illustrated in the accompanying drawings, wherein like reference numerals refer to the like elements throughout. Embodiments are described below to explain the present invention by referring to the figures.

FIG. 1 is a flowchart illustrating a method of decoding extension data for surround, according to an embodiment of the present invention.

In operation 100, a bit stream may be inverse multiplexed, e.g., after being received from an encoding terminal.

In operation 105, a base layer of audio data, e.g., inverse multiplexed in operation 100, may be decoded. Here, an example of operation 105 is shown by the function bsac_base_element( ), shown by the reference numeral 200 in the example syntax illustrated in FIG. 2A.

In operation 110, an enhancement layer of the audio data, e.g., inverse multiplexed in operation 100, may be decoded. Here, an example of operation 110 is shown by reference numeral 210 in the example syntax of FIG. 2A. As shown by reference numeral 210, an enhancement layer of a predetermined frequency band corresponding to an upper layer of the base layer may be decoded using the function bsac_layer_element( ). In addition, operation 110 may be repeated until the remaining enhancement layers are completely decoded.

In operation 115, it may be determined whether there are additional bit streams that also should be decoded, e.g., from among the bit stream inverse multiplexed in operation 100. Here, an example of operation 115 is shown by reference numeral 215 in the example syntax of FIG. 2A.

When it is determined that there are additional bit streams to be decoded, a complete code may be detected, the complete code is an identifier indicating that a payload of audio data including a base layer and an enhancement layer has been completed, in operation 120. An example of the identifier indicating that a payload of audio data has been completed includes "zero_code", shown by reference numeral 215 of the example syntax of FIG. 2A. In one embodiment, such a "zero_code" identifier is required in completing an arithmetic decoding, and is formed of 32 continuous '0' values.

In operation 125, a start code may be detected, the start code is an identifier indicating that a payload of extension data has been started. An example of the identifier indicating that a payload of extension data has been started includes "sync_word", shown by reference numeral 220 of the example syntax of FIG. 2A. In one embodiment, such a "sync_word" identifier is a code of 4 bits, and formed of 4 continuous '1' values.

Here, the extension data denotes data for extending and processing audio data for a predetermined use. Examples of the extension data include data for extending a channel of audio data, data for extending a bandwidth of audio data, data for generating a code for checking an error, etc. Meta data of audio data, fill element of audio data, or the like can be included rather than the extension data.

In operation 130, an identifier indicating a type of the extension data may be detected. An example of the identifier indicating the type of the extension data includes "extension_type", shown by reference numeral 225 of the example syntax of FIG. 2A. As only an example, FIG. 2B is a table illustrating "extension_type". In one embodiment, "extension_type" is a pre-set bit strings, with each bit string being pre-set accordingly to a certain purpose.

In operation 135, it may be determined whether the type of the extension data, e.g., as detected in operation 130, indicates additional information for decoding the audio data to surround data. Here, operation 135 may be performed by the illustrated "case EXT_BSAC_SAC_DATA", shown by reference numeral 230 of the example syntax of FIG. 2A. In one embodiment, whether the type of the extension data shows the additional information may be determined based on the table of FIG. 2B, e.g., whether the "extension_type" shows a symbol 'EXT_BSAC_SAC_DATA' while having a value of '0010'.

When it is determined that the type of the extension data shows the additional information, in operation 135, the additional information may be decoded, in operation 140. Here, in an embodiment, operation 140 may be performed by the function extended_bsac_sac_data( ), shown by reference numeral 235 of the example syntax of FIG. 2A.

In operation 145, the basic layer decoded in operation 105 and the enhancement layer decoded in operation 110 may be up-mixed to a multi-channel using the additional information decoded in operation 140. The term up-mixed can be used herein as meaning a conversion or decoding of one more signals or data steams into additional signals or data streams, such as up-mixing a mono signal into left and right audio signals.

When it is determined that the type of the extension data does not indicate the additional information, e.g., in the detection operation performed in operation 135, extension data corresponding to the type of the extension data shown by the identifier detected in operation 130 may be decoded, in operation 150. Examples of the type of the extension data and a corresponding purpose of the extension data are shown in the table of FIG. 2B, noting that alternatives are available.

After operation 145, it may be determined whether the remaining bits after decoding exceeds pre-set bits, in operation 155. For example, in an embodiment, in the example syntax of FIG. 2A, it may be determined whether bits remaining after decoding using the function "while (bit_to_decode( )>4", shown by reference numeral 240, exceeds 4 bits.

When it is determined that the remaining bits after decoding exceeds the pre-set bits, in operation 155, operations 130 through 145 may be repeated.

Figure 3:
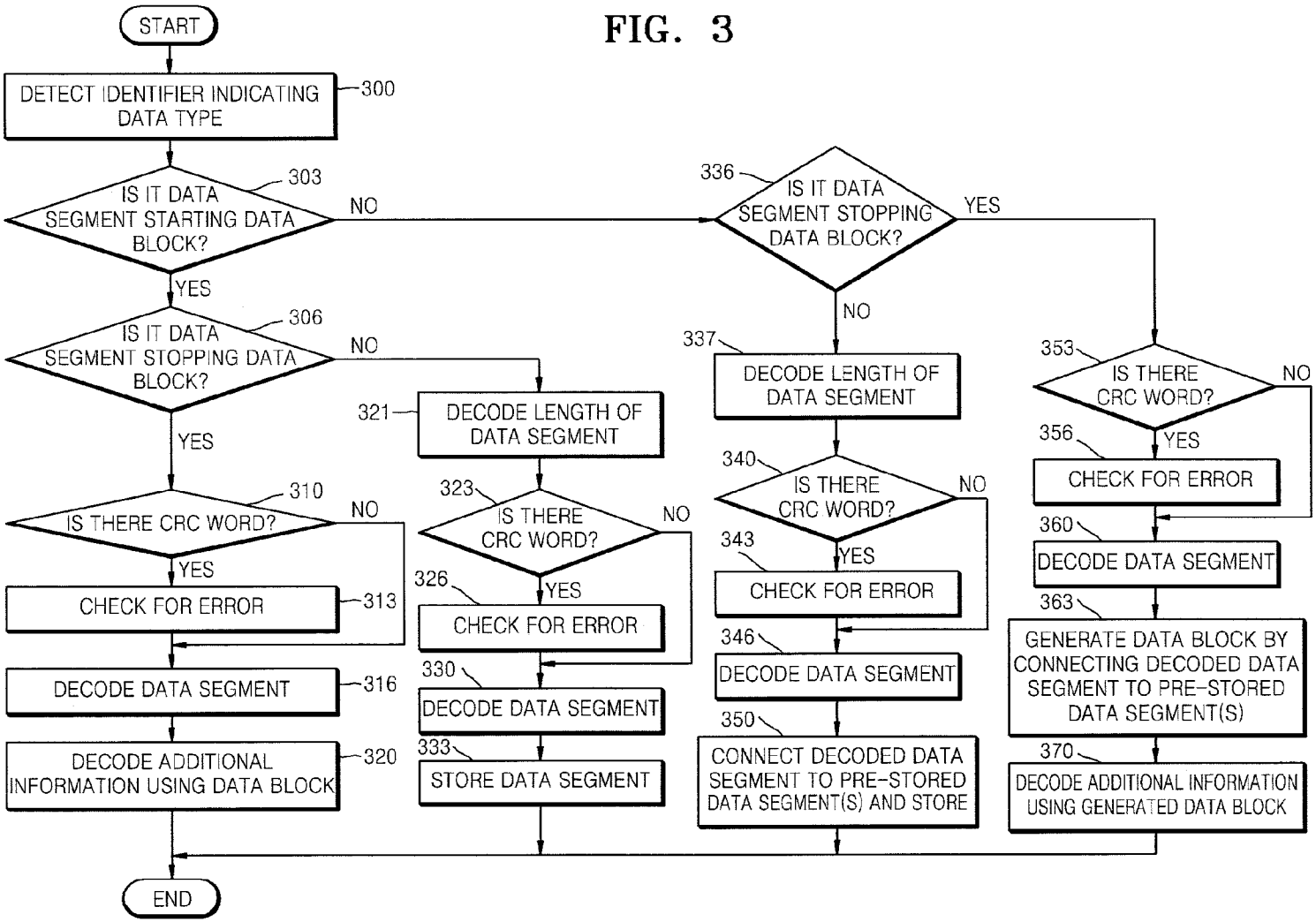
FIG. 3 is a flowchart illustrating operation 140, e.g., as included in the method of FIG. 1, according to an embodiment of the present invention.

FIG. 3 is a flowchart illustrating operation 140, such as included in the method of FIG. 1, according to an embodiment of the present invention.

First, an identifier indicating a data type of an encoded data segment may be detected in operation 300, e.g., by dividing a data block, as a unit for processing additional information for decoding audio data to surround data, to a predetermined unit. Here, according to an embodiment, the data block is divided according to a unit for encoding audio data. An example of the identifier indicating a data type of a data segment includes "ancType", shown by reference numeral 400 of the example syntax illustrated in FIG. 4A. According to an embodiment of the present invention, examples of a data type of a data segment shown by each "ancType" are shown in the table of FIG. 4B. Here, referring to FIG. 4B, when 'ancType' has a value of '0x0', SacDataFrame(0) means that the data segment is formed of an MPEG surround frame. Alternatively, when 'ancType' has a value of '0x1', SacDataFrame(1) means that the data segment is formed of an MPEG surround header and an MPEG surround frame.

After operation 300, an identifier, indicating whether a data segment that is to be decoded is a data segment starting the data block, may be detected, and it may further be determined whether the corresponding data segment is a data segment starting the data block, in operation 303, using the detected identifier. In an embodiment, an example of the identifier of operation 303 may include "ancStart", shown by reference numeral 405 of the example syntax of FIG. 4A.

When it is determined that the corresponding data segment is a data segment starting the data block, in operation 303, an identifier, indicating whether a data segment that is to be decoded is a data segment stopping the data block, may be detected, and it may further be determined whether the corresponding data segment is a data segment stopping the data block, in operation 306, using the detected identifier. In an embodiment, an example of the identifier of operation 306 may include "ancStop", shown by reference numeral 410 of the example syntax of FIG. 4A.

When it is determined that the corresponding data segment is a data segment stopping the data block, in operation 306, it may be determined whether a cyclic redundancy check (CRC) word exists, in operation 310, for example. Here, in an embodiment, a code, such as "bs_crc_flag", shown by reference numeral 415 of the example syntax of FIG. 4A, may be used in determining whether the CRC word exists. For example, in this embodiment, 0 may be allocated to "bs_crc_flag" to show that the CRC word does not exists, and 1 may be allocated to "bs_crc_flag" to show that the CRC word exists.

When it is determined that the CRC word exists, in operation 310, it may be determined whether the corresponding data block has an error by detecting the CRC word, in operation 313. Here, in an embodiment, the error in the corresponding data block may be checked by detecting 'ancCrcWord', defined by an equation 'G(x)=x^8+x^2+x+1', shown by reference numeral 420 of the example syntax of FIG. 4A.

After operation 310 or 313, for example, the corresponding data segment may be decoded, in operation 316.

The data segment decoded in operation 316 may be a data segment starting the data block and simultaneously a data segment stopping the data block, and thus the decoded data segment may not be a data segment but the data block itself. Accordingly, the additional information for decoding audio data to surround data may be decoded in operation 320 using the corresponding data block. In this case, in such an embodiment, 1 may be allocated to both "ancStart" and "ancStop" in the corresponding data segment.

When it is determined that the corresponding data segment is not a data segment stopping the data block in operation 306, a length of the corresponding data segment may be decoded, in operation 321. Here, performance of operation 312 is shown by reference numeral 413 in the example syntax of FIG. 4A. As shown by the reference numeral 413 in the example syntax of FIG. 4A, a pre-set "count" may be allocated to "cnt", as a variable used in decoding the length of the data segment, such that when the value of "cnt" is 255, a value obtained by subtracting 1 from "esc_count" is further added to "cnt". However, when the corresponding data segment is a data segment stopping the data block, the length of the data segment may not be transmitted from an encoding terminal, and thus not decoded.

After operation 321, it may be determined whether a CRC word exists, in operation 323. The code, such as "bs_crc_flag", shown by reference numeral 415 of the example syntax of FIG. 4A, may be used in determining whether the CRC word exists. For example, in an embodiment, 0 can be allocated to "bs_crc_flag" to show that the CRC word does not exist, and 1 can be allocated to "bs_crc_flag" to show that the CRC word does exist.

When it is determined that the CRC word exists, in operation 323, it may further be determined whether the corresponding data block has an error by detecting the CRC word, in operation 326. According to an embodiment, in operation 326, an error in the corresponding data block may be checked by detecting 'ancCrcWord', defined by the equation 'G(x)=x^8+x^2+x+1', shown by reference numeral 420 of the example syntax of FIG. 4A.

After operation 323 or 326, a data segment corresponding to the length of the data segment decoded in operation 321 may be decoded, in operation 330.

The data segment decoded in operation 330 may further be stored, in operation 333.

When it is determined that the corresponding data segment is not a data segment starting the data block, in operation 303, an identifier, identifying whether the data segment that is to be decoded is a data segment stopping the data block, may be determined, and it may further be determined whether the corresponding data segment is a data segment stopping the data block, in operation 336, using the detected identifier.

When it is determined that the corresponding data segment is not a data segment stopping the data block, in operation 336, the length of the corresponding data segment may be decoded, in operation 337. Here, in an embodiment, as shown by reference numeral 413 in the example syntax of FIG. 4A, the pre-set "count" may be allocated to "cnt", which can be a variable used in decoding the length of the data segment, and when the value of "cnt" is 255, a value obtained by subtracting 1 from "esc_count" may further be added to "cnt". However, when the corresponding data segment is a data segment stopping the data block, the length of the data segment may not be transmitted from an encoding terminal, and thus not decoded.

After operation 337, it may be determined whether a CRC word exists, in operation 340. The code, such as "bs_crc_flag", shown by reference numeral 415 of the example syntax of FIG. 4A, may be used in determining whether the CRC word exists. For example, in an embodiment, 0 can be allocated to "bs_crc_flag" to show that the CRC word does not exist, and 1 can be allocated to "bs_crc_flag" to show that the CRC word does exist.

When it is determined that the CRC word exists, in operation 340, it may further be determined whether the corresponding data block has an error by detecting the CRC word, in operation 343. Here, in an embodiment, in operation 343, an error in the corresponding data block may be checked by detecting 'ancCrcWord', defined by the equation 'G(x)=x^8+x^2+x+1', shown by reference numeral 420 of the example syntax of FIG. 4A.

After operation 340 or 343, a data segment corresponding to the length of the data segment decoded in operation 337 may be decoded, in operation 346.

In the data segment decoded in operation 346, according to an embodiment of the present invention, 0 may be allocated to both "ancStart" and "ancStop", and thus the data segment decoded in operation 346 may not be data segment starting the data block or a data segment stopping the data block, but a data segment in the middle of the data block. Accordingly, the data segment decoded in operation 346 may be connected to pre-stored data segment(s) and then stored, for example, in operation 350. Here, as an example, the pre-stored data segment(s) may be data segment(s) pre-stored and connected starting from a data segment, in which 1 is allocated to "ancStart". Here, operation 350 may be performed by ancDataSegmentByte[i], shown by reference numeral 425 in the example syntax of FIG. 4A.

When it is determined that the corresponding data segment is a data segment stopping the data block, in operation 336, it may further be determined whether a CRC word exists, in operation 353. The code, in an embodiment, such as "bs_crc_flag", shown by reference numeral 415 of the example syntax of FIG. 4A, may be used in determining whether the CRC word exists. Here, for example, 0 can be allocated to "bs_crc_flag" to show that the CRC word does not exist, and 1 can be allocated to "bs_crc_flag" to show that the CRC word does exist.

When it is determined that the CRC word exists, in operation 353, it may be determined whether the corresponding data block has an error by detecting the CRC word, in operation 356. In operation 356, in an embodiment, an error in the corresponding data block may be checked for by detecting 'ancCrcWord', defined by the equation 'G(x)= x^8+x^2+x+1', shown by reference numeral 420 of the example syntax of FIG. 4A.

After operation 353 or 356, the corresponding segment may be decoded, in operation 360.

A data block may be generated in operation 363 by connecting the corresponding data segment decoded in operation 360 to a pre-stored data segment. Here, in an embodiment, operation 363 may be performed by ancDataSegmentByte[i], as shown by the reference numeral 425 of the example syntax of FIG. 4A.

Using the data block generated in operation 363, the additional information for decoding audio data to surround data may further be decoded, in operation 370.

Figure 5:
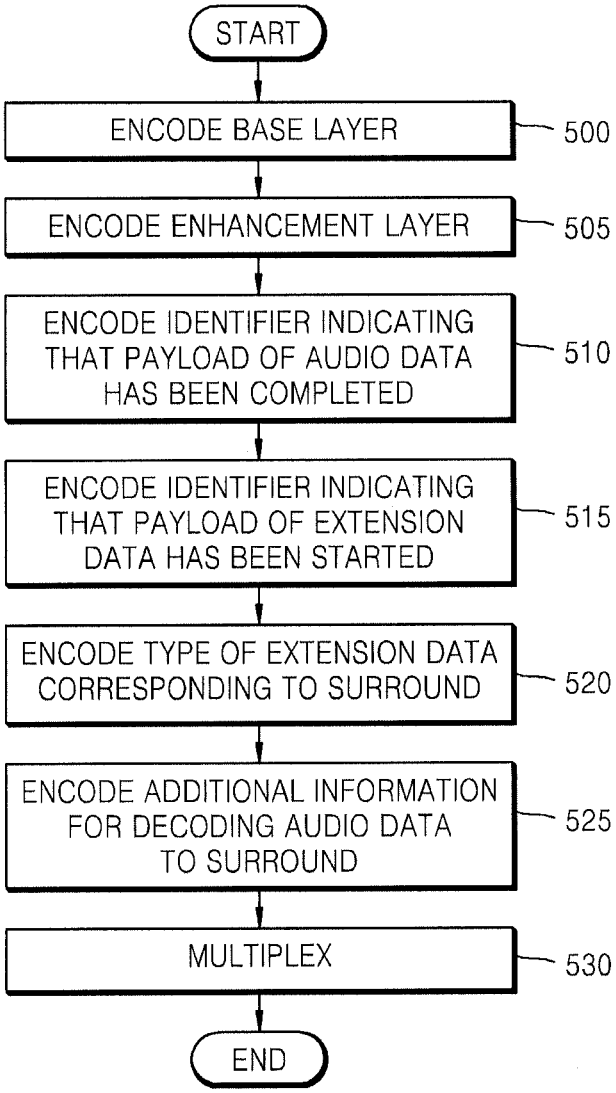
FIG. 5 is a flowchart illustrating a method of encoding extension data for surround, according to an embodiment of the present invention.

FIG. 5 is a flowchart illustrating a method of encoding extension data for surround, according to an embodiment of the present invention.

First, a base layer of audio data may be encoded, in operation 500.

Then, an enhancement layer of the audio data may be encoded, in operation 505. Here, an enhancement layer in a predetermined frequency band corresponding to an upper layer of the base layer may be encoded in operation 505, and a plurality of enhancement layers may further be repeatedly encoded until all enhancement layers are encoded.

After operation 505, a complete code may be encoded, the complete code being an identifier indicating that a payload of the audio data including the base layer and the enhancement layer has been competed, in operation 510. An example of such an identifier indicating that the payload of the audio data has been completed may include "zero_code". In an embodiment, such a "zero_code" identifier is required in completing an arithmetic decoding and is formed of 32 continuous '0' values, for example.

After operation 510, a start code may be encoded, the start code being an identifier indicating that a payload of extension data has been started, in operation 515. In an embodiment, an example of the identifier indicating that the payload of the extension data has been started may include "sync_word". Here, such a "sync_word" identifier is a code in 4 bits, and is formed of 4 continuous '1' values, for example.

Then, an identifier indicating a type of the extension data may be encoded, in operation 520. An example of the identifier indicating the type of the extension data includes "extension_type". In addition, according to an embodiment, examples of "extension_type" are shown in the table illustrated in FIG. 2B, again noting that alternatives are available. In such an embodiment, "extension_type" is a pre-set bit strings, with each bit string being pre-set accordingly to a certain purpose.

When the type of the extension data corresponds to MPEG surround, additional information for decoding the audio data to surround data may be encoded, in operation 525.

In operation 530, a bit stream may further be generated by multiplexing the base layer, e.g., encoded in operation 500, the enhancement layer, e.g., encoded in operation 505, the complete code, e.g., encoded in operation 510, the start code, e.g., encoded in operation 515, the type of the extension data, e.g., encoded in operation 520, and the additional information, e.g., encoded in operation 525.

Figure 6:
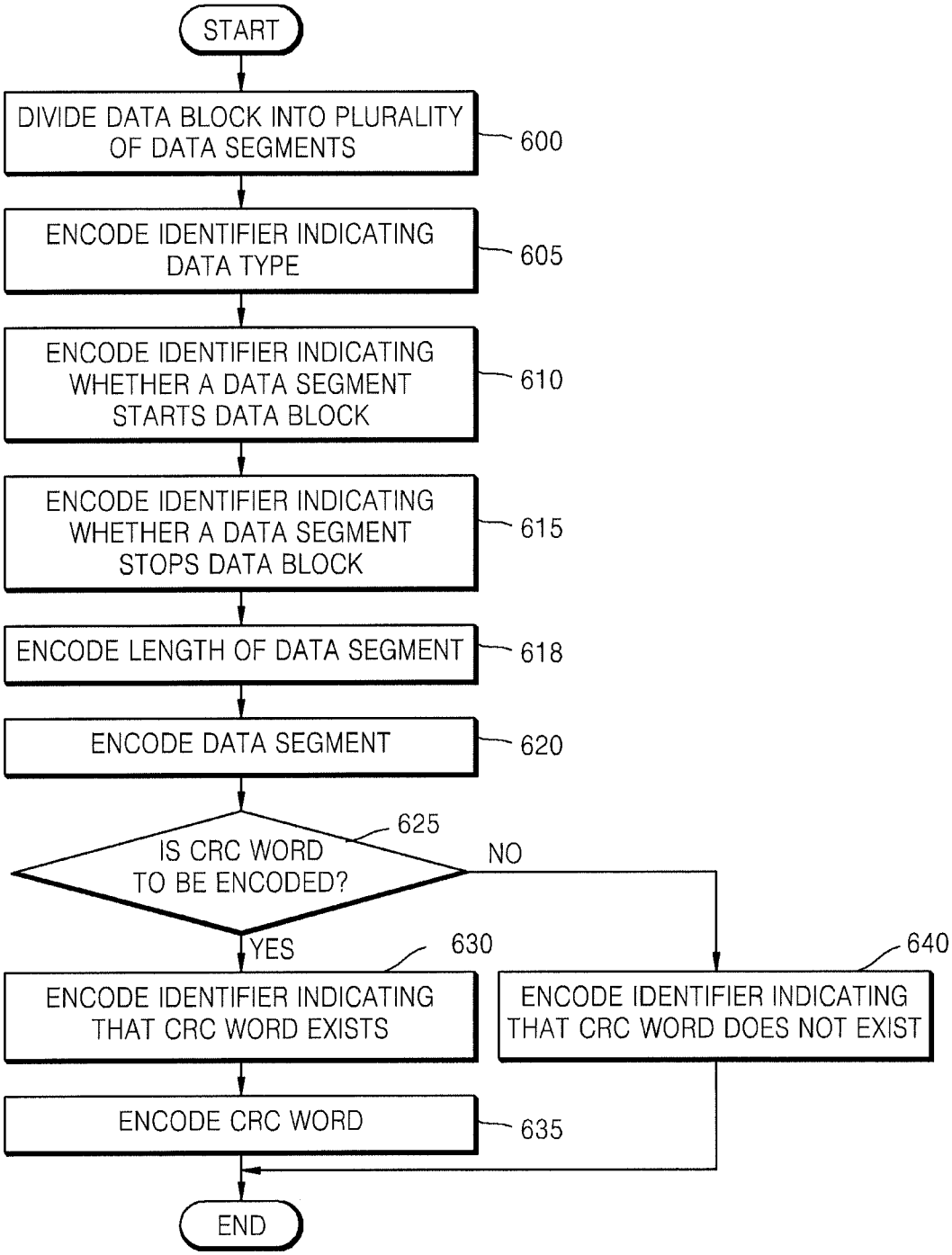
FIG. 6 is a flowchart illustrating operation 525, e.g., as included in the method of FIG. 5, according to an embodiment of the present invention.

FIG. 6 is a flowchart illustrating operation 525, such as included in the method of FIG. 5, according to an embodiment of the present invention.

First, a data block, as a unit for processing additional information for decoding audio data to surround data, may be divided into at least one data segment using a unit for encoding audio data, in operation 600.

In operation 605, an identifier indicating the data type of the data segment may be encoded. In an embodiment, an example of the identifier indicating the data type of the data segment includes "ancType", with FIG. 4B being a table illustrating examples of the data types of the data segment shown by each "ancType". In an embodiment, and referring to the table of FIG. 4B, when 'ancType' has a value of '0x0', SacDataFrame(0) is formed of an MPEG surround frame, and when 'ancType' has a value of '0x1', SacDataFrame(1) is formed of an MPEG surround header and an MPEG surround frame.

After operation 605, an identifier indicating whether the data segment is a data segment starting the data block may be encoded, in operation 610. In an embodiment, an example of the identifier indicating whether the data segment is a data segment starting the data block includes "ancStart".

Then, an identifier indicating whether the data segment is a data segment stopping the data block may be encoded, in operation 615. In an embodiment, an example of the identifier indicating whether the data segment is a data segment stopping the data block includes "ancStop".

In operation 618, a length of the data segment may be encoded. Here, when the corresponding data segment is a data segment stopping the data block, the length of the data segment may not be required, and thus not encoded.

In operation 620, the data segment may be encoded.

In operation 625, it may be further determined whether a CRC word is to be encoded, the CRC word can be used to check an error in the data segment, e.g., encoded in operation 620.

When it is determined to encode the CRC word, in operation 625, an identifier indicating that the CRC word exists may be encoded, in operation 630. Here, in an embodiment, an example of an identifier indicating that the CRC word exists includes "bs_crc_flag". Accordingly, in this example, in operation 630, 1 is allocated to "bs_crc_flag" in order to show that the CRC word exists.

After operation 630, the CRC word may be encoded, in operation 635.

When it is determined not to encode the CRC word, in operation 625, an identifier indicating that the CRC word does not exist may be encoded, in operation 630. An example of the identifier indicating that the CRC word does not exist includes "bs_crc_flag". For example, in operation 640, 0 is allocated to "bs_crc_flag" in order to show that the CRC word exists.

Figure 7:
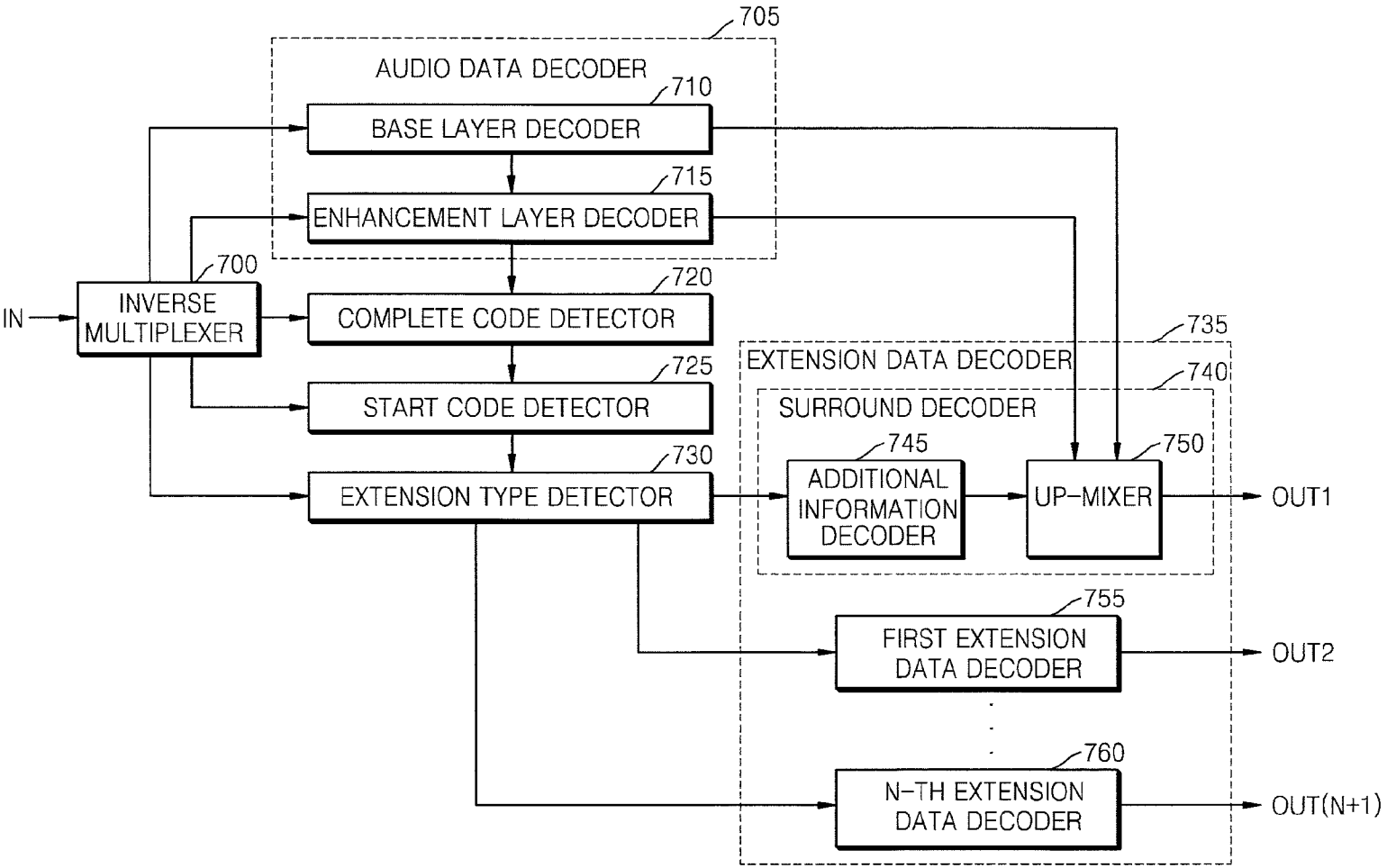
FIG. 7 is a block diagram illustrating an apparatus for decoding extension data for surround, according to an embodiment of the present invention.

FIG. 7 is a block diagram illustrating an apparatus decoding extension data for surround, according to an embodiment of the present invention. Herein, including in the attached claims, the use of the term apparatus should be considered synonymous with the term system, e.g., such elements of FIG. 7 may be embodied in a single body or as separate bodies, potentially at different locations, or intermixed between the same. Thus, the apparatus may include an inverse multiplexer 700, an audio data decoder 705, a complete code detector 720, a start code detector 725, an extension type detector 730, and an extension data decoder 735, for example.

The inverse multiplexer 700 may receive a bit stream, e.g., from an encoding terminal through an input terminal IN.

The audio data decoder 705 may decode audio data hierarchically encoded. Here, the audio data decoder may include a base layer decoder 710 and an enhancement layer decoder 715, for example.

The base layer decoder 710 may decode a base layer of audio data, e.g., inverse multiplexed in the inverse multiplexer 700. In an embodiment, in the base layer decoder 710, the base layer may be decoded using the function bsac_base_element( ), e.g., as shown by reference numeral 200 in the example syntax of FIG. 2A.

The enhancement layer decoder 715 may decode an enhancement layer of the audio data, e.g., as inverse multiplexed in the inverse multiplexer 700. In an embodiment, in the enhancement layer decoder 715, the enhancement layer may be decoded using the function bsac_layer_element( ), e.g., as shown by reference numeral 210 in the example syntax of FIG. 2A. Here, regarding reference numeral 210 of FIG. 2A, an enhancement layer of a predetermined frequency band corresponding to an upper layer of the base layer may be decoded using the function bsac_layer_element( ), and such decoding may be repeated until all enhancement layers are decoded.

The complete code detector 720 may determine whether there are additional bit streams to be decoded, e.g., from among the bit streams inverse multiplexed in operation 700. When there are additional bit streams to be decoded, the complete code detector 720 may detect a complete code, as an identifier indicating that a payload of the audio data including the base layer and the enhancement layer has been completed. In an embodiment, an example of the identifier indicating that the payload of the audio data has been completed includes "zero_code", shown by reference numeral 215 of the example syntax of FIG. 2A. Here, in this example, such a "zero_code" identifier is required in completing an arithmetic decoding and is formed of 32 continuous '0' values.

The start code detector 725 may detect a start code, as an identifier indicating that a payload of extension data has been started. In an embodiment, an example of the identifier indicating that a payload of extension data has been started includes "sync_word", shown by reference numeral 220 of the example syntax of FIG. 2A. Here, in this example, such a "sync_word" identifier is a code in 4 bits, and formed of 4 continuous '1' values.

Here, the extension data is data for extending and processing audio data for a predetermined use. Examples of such extension data include data for extending a channel of audio data, data for extending a bandwidth of audio data, data for generating a code for checking an error, etc, for example. Rather than the extension data, meta data of the audio data, a fill element of the audio data, or the like can be included.

The extension type detector 730 may detect an identifier indicating a type of the extension data. In an embodiment, an example of the identifier indicating a type of the extension data includes "extension_type", shown by reference numeral 225 of the example syntax of FIG. 2A. Here, FIG. 2B is a table illustrating examples of "extension_type", with "extension_type" being pre-set bit strings, and each bit string being pre-set to correspond to a certain purpose.

The extension data decoder 735 may decode the extension data. Here, the extension data decoder 735 may include a surround decoder 740 and first through Nth extension data decoders 755 through 760, for example.

The surround decoder 740 may up-mix the audio data decoded in the audio data decoder 705 to surround data, for example. Here, the surround decoder 740 may include an additional information decoder 745 and an up-mixer 750, for example.

As an example, when the additional information decoder 745 determines that the type of the extension data detected in the extension type detector 730 shows additional information for decoding audio data to surround data, the additional information decoder 745 decodes the additional information. In an embodiment, the additional information decoder 745 may decode the additional information using the function extended_bsac_sac_data( ), shown by reference numeral 235 of the example syntax of FIG. 2A.

In addition, the additional information decoder 745 may determine whether the type of the extension data shows the additional information, e.g., by determining whether "extension_type" shows the symbol 'EXT_BSAC_SAC_DATA' while having a value of '0010' from the table illustrated in FIG. 2B.

The up-mixer 750 may up-mix the base layer, e.g., decoded in the base layer decoder 710, and the enhancement layer, e.g., decoded in the enhancement layer decoder 715, to a multi-channel using the additional information decoded in the additional information decoder 745. For example, a stereo audio signal is generated as an output of the up-mixer 750. To this end, MPEG surround is preferably used, but is not limited thereto. One of a mono signal and a stereo signal is used as the audio data for the stereo audio signal.

Here, the first through Nth extension data decoders 755 through 760 may decode extension data corresponding to the type of extension data shown by the identifier detected by the extension type detector 730. Example types of extension data and purposes of corresponding to each type of extension data are shown in the table of FIG. 2B. Decoding results of the first through Nth extension data decoders 755 through 760 may, thus, be output through output terminals OUT2 through OUT(N+1), for example.

Figure 8:
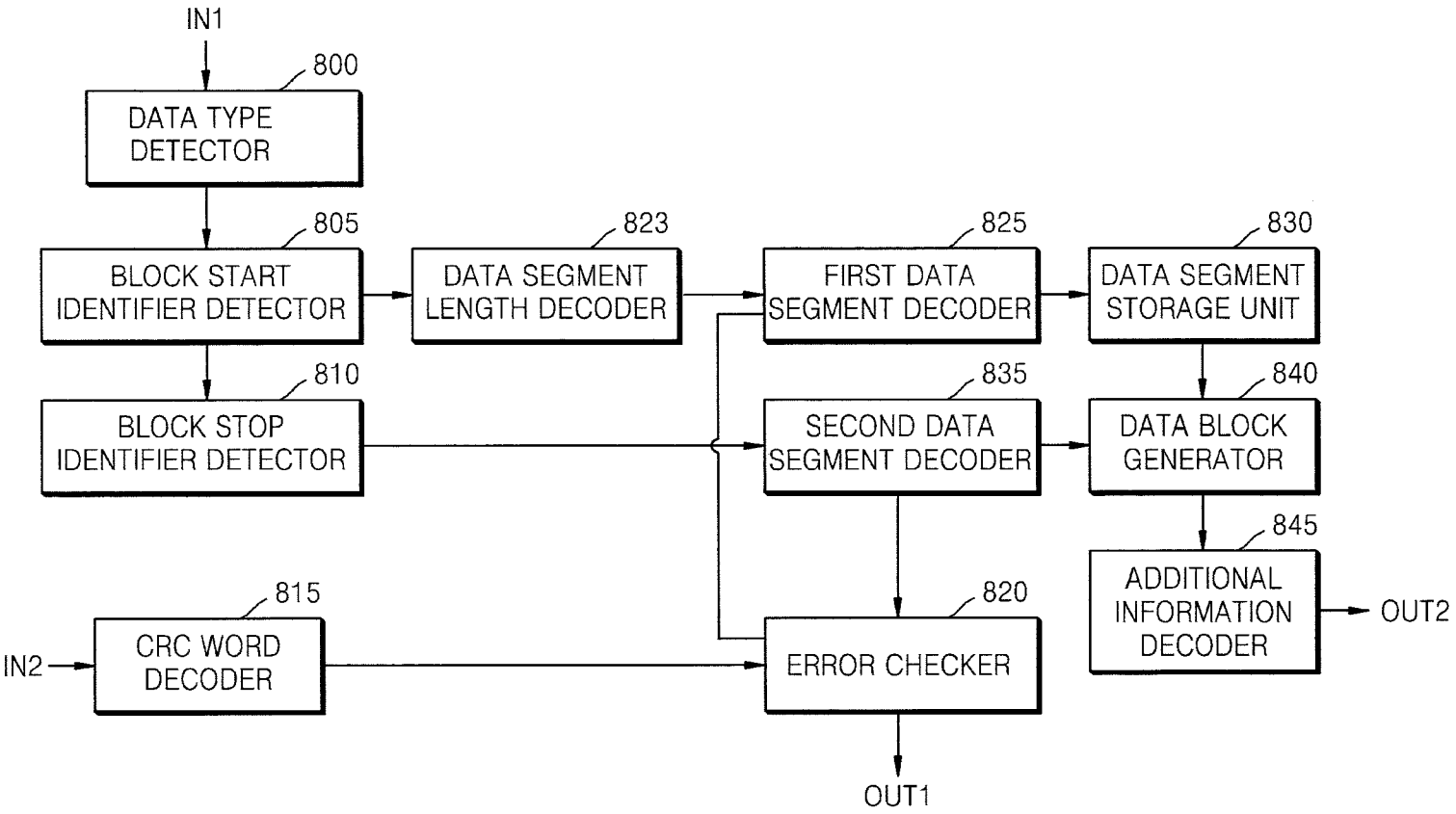
FIG. 8 is a block diagram illustrating a surround decoder, e.g., as included in the apparatus of FIG. 7, according to an embodiment of the present invention.

FIG. 8 is a block diagram illustrating the surround decoder 740, e.g., as included in the apparatus of FIG. 7. The surround decoder 740 may include a data type detector 800, a block start identifier detector 805, a block stop identifier detector 810, a CRC word decoder 815, an error checker 820, a data segment length decoder 823, a first data segment decoder 825, a data segment storage unit 830, a second data segment decoder 835, a data block generator 840, and an addition information decoder 845, for example.

The data type detector 800 may detect an identifier indicating a data type of an encoded data segment, in which a data block, which is a unit for processing additional information for decoding audio data to surround data, is divided into a predetermined unit. Here, the data block may be divided into a unit for encoding audio data. In an embodiment, an example of the identifier indicating a data type of a data segment includes "ancType", shown by reference numeral 400 of the example syntax of FIG. 4A, for example. In such an embodiment, FIG. 4B illustrates examples of a data type of a data segment shown by each "ancType". Referring to the table of FIG. 4B, in such an embodiment, when 'ancType' has a value of '0x0', SacDataFrame(0) is formed of an MPEG surround frame, and when 'ancType' has a value of SacDataFrame(1) is formed of an MPEG surround header and an MPEG surround frame, for example.

The block start identifier detector 805 may detect an identifier indicating whether the data segment that is to be decoded is a data segment starting the data block, and may further determine whether the corresponding data segment is a data segment starting the data block using the detected identifier. In an embodiment, an example of the identifier indicating whether the data segment is a data segment starting the data block includes "ancStart", shown by reference numeral 405 in the example syntax of FIG. 4A.

The block stop identifier detector 810 may detect an identifier indicating whether the data segment that is to be decoded is a data segment stopping the data block, and may further determine whether the corresponding data segment is a data segment stopping the data block using the detected identifier. In an embodiment, an example of the identifier indicating whether the data segment is a data segment stopping the data block includes "ancStop", shown by reference numeral 410 in the example syntax of FIG. 4A.

The CRC word decoder 815 may determine whether a CRC word exists, and when the CRC word does exist, further detect and decode the CRC word. Here, the CRC word decoder 815 may determine whether the CRC word exists, e.g., by using a code such as "bs_crc_flag", shown by reference numeral 415 of the example syntax of FIG. 4A. For example, in an embodiment, 0 can be allocated to "bs_crc_flag" to show that the CRC word does not exist, and 1 can be allocated to "bs_crc_flag" to show that the CRC word does exist.

The error checker 820 may check whether there is an error in the corresponding data block, for example. In an embodiment, the error checker 820 can check the error by detecting 'ancCrcWord', defined by the equation 'G(x)=x^8+x^2+x+1', shown by reference numeral 420 of the example syntax of FIG. 4A. The result of the error checker 820 may be output through an output terminal OUT1, for example.

The data segment length decoder 823 may decode a length of the corresponding data segment. For example, the data segment length decoder 823 may decode the length of the corresponding data segment, shown by reference numeral 413 in the example syntax of FIG. 4A. Here, in this example embodiment, regarding the reference numeral 413 in the example syntax of FIG. 4A, pre-set "count" is allocated to "cnt", which is a variable used in decoding the length of the data segment, and when the value of "cnt" is 255, a value obtained by subtracting 1 from "esc_count" is further added to "cnt". However, when the corresponding data segment is a data segment stopping the data block, the length of the data segment may not be transmitted from an encoding terminal, and thus not decoded.

When the block start identifier detector 805 determines that the data segment starts the data block and the block stop identifier detector 810 determines that the data segment stops the data block, the corresponding data segment starts and stops the data block, and thus the data block itself. In this case, in an embodiment, 1 may be allocated to both "ancStart" and "ancStop". Accordingly, the second data segment decoder 835 may decode the corresponding data block, and the additional information decoder 845 may decode additional information for decoding audio data to surround data using the data block decoded in the second data segment decoder 835.

When the block start identifier detector 805 determines that the data segment starts the data block and the block stop identifier detector 810 determines that the data segment does not stop the data block, the first data segment decoder 825 may decode a data segment corresponding to the length decoded in the data segment length decoder 823, and the data segment storage unit 830 may further store the data segment decoded in the first data segment decoder 825, for example.

Still further, when the block start identifier detector 805 determines that the data segment does not start the data block and the block stop identifier detector 810 determines that the data segment does not stop the data block, the corresponding data segment can be determined to be in the middle of the data block, in which case 0 may be allocated to both "ancStart" and "ancStop". Accordingly, the first data segment decoder 825 may decode a data segment corresponding to the length decoded in the data segment length decoder 823, and the data segment storage unit 830 may store the data segment decoded in the first data segment decoder 825 after connecting the data segment to pre-stored data segment(s). Here, in an embodiment, the pre-stored data segment(s) may be data segment(s) pre-stored and connected starting from a data segment, in which 1 is allocated to "ancStart". In addition, the data segment storage unit 830 may operate according to ancDataSegmentByte[i], shown by reference numeral 425 in the example syntax of FIG. 4A.

When the block stop identifier detector 805 determines that the data segment stops the data block, the second data segment decoder 835 may decode the corresponding data segment, and the data block generator 840 may generate a data block by connecting the data segment decoded in the second data segment decoder 835 to the pre-stored data segment(s). Then, the additional information decoder 845 may decode the additional information using the data block generated in the data block generator 840. The additional information decoded in the additional information decoder 845 may further be output through an output terminal OUT2, for example.

Figure 9:
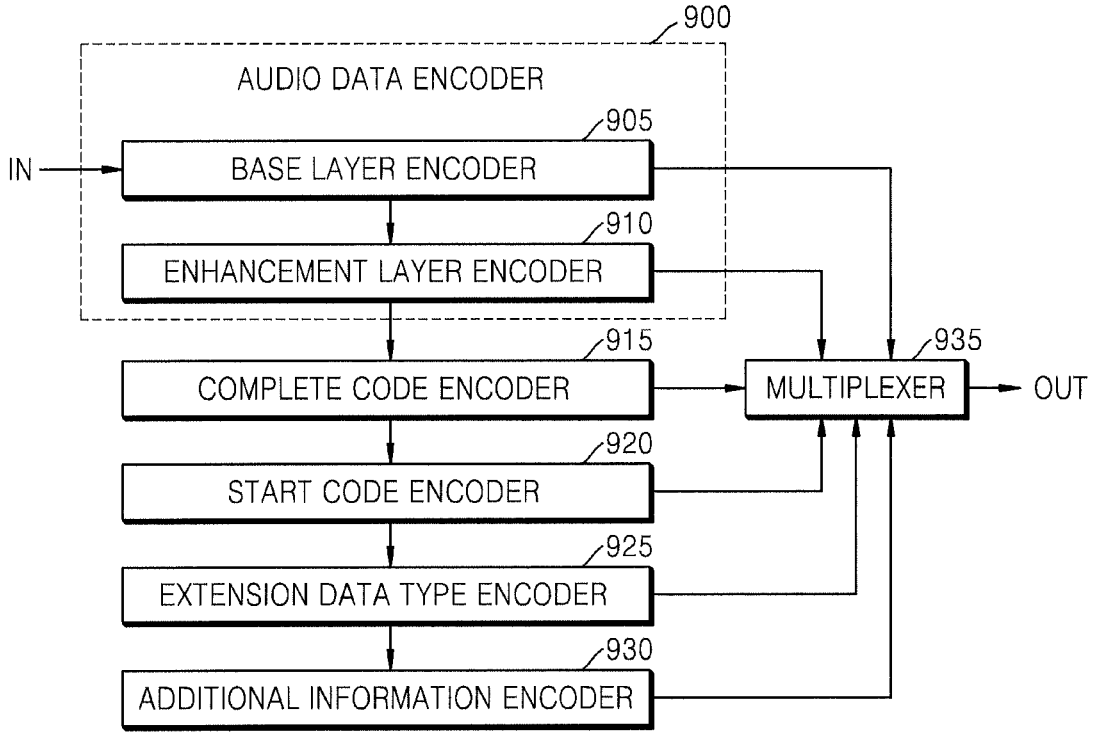
FIG. 9 is a block diagram illustrating an apparatus for encoding extension data for surround, according to an embodiment of the present invention.

FIG. 9 is a block diagram illustrating an apparatus encoding extension data for surround, according to an embodiment of the present invention. Herein, again, including in the attached claims, the use of the term apparatus should be considered synonymous with the term system, e.g., such elements of FIG. 9 may be embodied in a single body or as separate bodies, potentially at different locations, or intermixed between the same. Thus, the apparatus may include an audio data encoder 900, a complete code encoder 915, a start code encoder 920, an extension data type encoder 925, an additional information encoder 930, and a multiplexer 935, for example.

The audio data encoder 900 may receive audio data through an input terminal IN and hierarchically encode the audio data. In addition, the audio data encoder 900 may include a base layer encoder 905 and an enhancement layer encoder 910, for example.

The base layer encoder 905 may encode a base layer of the audio data.

Further, the enhancement layer encoder 910 may encode an enhancement layer of the audio data. In an embodiment, the enhancement layer encoder 910 may encode an enhancement layer in a predetermined frequency band corresponding to an upper layer of the base layer, and a plurality of enhancement layers may be repeatedly encoded until all enhancement layers are encoded, for example.

The complete code encoder 915 may encode a complete code, as an identifier indicating that a payload of the audio data including the base layer and the enhancement layer has been completed. In an embodiment, an example of the identifier indicating that a payload of audio data has been completed includes "zero_code". Here, in this embodiment, such a "zero_code" identifier may be required in completing an arithmetic decoding, and formed of 32 continuous '0' values.

The start code encoder 920 may encode a start code, as an identifier indicating that a payload of extension data has been started. In an embodiment, an example of the identifier indicating that a payload of extension data has been started includes "sync_word". Here, in this embodiment, such a "sync_word" indicator may be a code in 4 bits, and formed of 4 continuous '1' values.

The extension data type encoder 930 may encode an identifier indicating a type of the extension data. In an embodiment, an example of the identifier indicating a type of extension data includes "extension_type". Here, FIG. 2B is a table illustrating examples of "extension_type", noting that alternatives are also available. Further, in such an embodiment, "extension_type" may be pre-set bit strings, with each bit string being pre-set to correspond to a certain purpose.

The extension data type encoder 930 may encode additional information for decoding audio data to surround data, when the type of the extension data is an MPEG surround, for example.

The multiplexer 935 may generate a bit stream by multiplexing the base layer encoded in the base layer encoder 905, the enhancement layer encoded in the enhancement layer encoder 910, the complete code encoded in the complete code encoder 915, a start code encoded in the start code encoder 920, the type of the extension data encoded in the extension data type encoder 925, and the additional information encoded in the additional information encoder 930, and output the generated bit stream through an output terminal OUT, for example.

Figure 10:
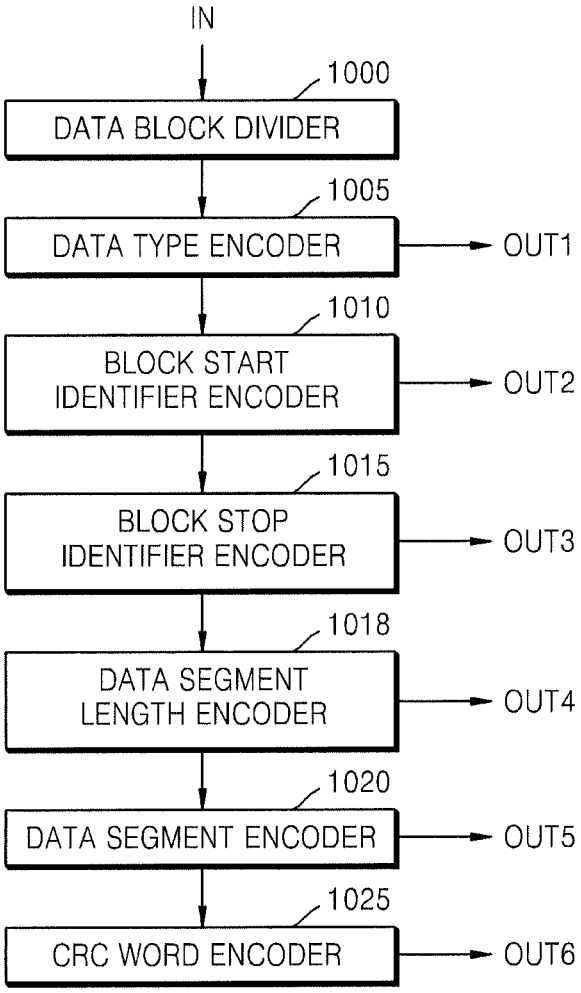
FIG. 10 is a block diagram illustrating an additional information encoder, e.g., as included in the apparatus of FIG. 9, according to an embodiment of the present invention.

FIG. 10 is a block diagram illustrating an additional information encoder 930, such as that included in the apparatus of FIG. 9. The additional information encoder 930 may include a data block divider 1000, a data type encoder 1005, a block start identifier encoder 1010, a block stop identifier encoder 1015, a data segment encoder 1020, and a CRC word encoder 1025, for example.

The data block divider 1000 may divide a data block, as a unit for processing additional information for decoding audio data to surround data, into at least one data segment in a unit for encoding audio data.

The data type encoder 1005 may encode an identifier indicating a data type of the data segment, e.g., as divided in the data block divider 1000. In an embodiment, an example of the identifier indicating the data type of the data segment includes "ancType". Further, here, FIG. 4B is a table illustrating examples of a data type of a data segment shown by each "ancType", noting that alternatives are also available. Referring to the table of FIG. 4B, in this embodiment, when a value of 'ancType' is '0x0', SacDataFrame(0) is formed of an MPEG surround frame, and when a value of 'ancType' is '0x1', SacDataFrame(1) is formed of an MPEG surround header and an MPEG surround frame, for example.

The block start identifier encoder 1010 may encode an identifier indicating whether the data segment, e.g., divided in the data block divider 1000, is a data segment starting the data block. In an embodiment, an example of the identifier indicating whether the data segment is a data segment starting the data block includes "ancStart".

The block stop identifier encoder 1014 may encode an identifier indicating whether the data segment that is to be decoded is a data segment stopping the data block. In an embodiment, an example of the identifier indicating whether the data segment is a data segment stopping the data block includes "ancStop".

The data segment length encoder 1018 may further encode a length of the data segment divided in the data block divider 1000. However, when the corresponding data segment stops the data block, the data segment length encoder 1018 may not encode the length since the length may not be required.

The data segment encoder 1020 may further encode the data segment, e.g., as divided in the data block divider 1000.

When a CRC word, which can check an error of the data segment encoded in the data segment encoder 1020, is determined to be encoded, the CRC word encoder 1025 may encode an identifier indicating that a CRC word exists, and the CRC word. In an embodiment, an example of the identifier indicating that the CRC word exists includes "bs_crc_flag". Here, in this embodiment, in the CRC word encoder 1025, 1 is allocated to "bs_crc_flag" in order to show that the CRC word does exist.

In addition, when the CRC word is determined to not to be encoded, the CRC word encoder 1025 may encode an identifier indicating that a CRC word does not exist. In an embodiment, an example of the identifier indicating that the CRC word does not exist includes "bs_crc_flag". Here, in this embodiment, in the CRC word encoder 1025, 0 is allocated to "bs_crc_flag" in order to show that the CRC word exists.

Embodiments of the present invention can also be embodied as computer (including an apparatus having an information processing function) readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices.

According to one or more embodiments of the present invention, in a method, medium, and apparatus encoding and decoding extension data for surround, a length of a payload corresponding to spatial information, which can up-mix an audio signal to a surround signal, is encoded and the spatial information is decoded in a decoder using the length of the payload, while encoding the spatial information to extension information.

Accordingly, compatibility of the spatial information can be provided, and the spatial information can be transmitted by effectively embedding the spatial information.

Although a few embodiments have been shown and described, it would be appreciated by those skilled in the art that changes may be made in these embodiments without departing from the principles and spirit of the invention, the scope of which is defined in the claims and their equivalents. Further, though embodiments may have been individually discussed or referenced, embodiments of the present invention are not limited thereto, i.e., an embodiment may include one or more of the detailed referenced embodiments.

What is claimed is:

1. A method of decoding spatial data embedded in a downmix data stream, the method comprising:

receiving an extension payload including a current data segment, wherein, a data block of the spatial data is split into one or more data segments including the current data segment;

obtaining information about a data type, information about a start of the data block and information about an end of the data block, for the current data segment;

obtaining length information of the current data segment included in the extension payload;

extracting the current data segment from the extension payload based on the obtained length information;

decoding the data block of the spatial data based on the current data segment and at least one of the obtained information about the data type, the obtained information about the start of the data block and the obtained information about the end of the data block; and upmixing a downmix signal using the spatial data.

2. The method of claim 1, further comprising:

performing cyclic redundancy check (CRC), if a CRC word exists in the current data segment.

3. The method of claim 1, wherein the extension payload includes a field indicating that an extension type corresponds to a surround process.

4. An apparatus for decoding spatial data embedded in a downmix data stream, the apparatus comprising:

a receiving unit which receives an extension payload including a current data segment, wherein a data block of the spatial data is split into one or more data segments including the current data segment;

a first obtainer which obtains information about a data type and information about a start of the data block and information about an end of the data block, for the current data segment;

a second obtainer which obtains length information of the current data segment included in the extension payload;

a decoder which extracts the current data segment from the extension payload based on the obtained length information and decodes the data block of the spatial data based on the current data segment and at least one of the obtained information about the data type, the obtained information about the start of the data block and the obtained information about the end of the data block; and an upmixer which upmixes a downmix signal using the spatial data.

5. The apparatus of claim 4, further comprising:

a CRC word detector which performs cyclic redundancy check (CRC), if a CRC word exists in the current data segment.

6. The apparatus of claim 4, wherein the extension payload includes a field indicating that an extension type corresponds to a surround process.

7. A non-transitory computer readable recording medium having recorded thereon a program for executing a method of decoding spatial data embedded in a downmix data stream, the method comprising:

receiving an extension payload including a current data segment, wherein a data block of the spatial data is split into one or more data segments including the current data segment;

obtaining information about a data type, information about a start of the data block and information about an end of the data block, for the current data segment;

obtaining length information of the current data segment included in the extension payload;

extracting the current data segment from the extension payload based on the obtained length information;

decoding the data block of the spatial data based on the current data segment, and at least one of the obtained information about the data type, the obtained information about the start of the data block, and the obtained information about the end of the data block; and upmixing a downmix signal using the spatial data.

* * * * *